US008735743B2

(12) United States Patent
Harmon et al.

(10) Patent No.: US 8,735,743 B2
(45) Date of Patent: May 27, 2014

(54) TRANSDUCER DEVICE HAVING STRAIN RELIEF COIL HOUSING

(75) Inventors: Aaron Harmon, Provo, UT (US); Trent Hassell, Pleasant Grove, UT (US)

(73) Assignee: Intelliserv, LLC, Houston, TX (US)

( * ) Notice: Subject to any disclaimer, the term of this patent is extended or adjusted under 35 U.S.C. 154(b) by 1149 days.

(21) Appl. No.: 12/612,165

(22) Filed: Nov. 4, 2009

(65) Prior Publication Data

US 2011/0100703 A1 May 5, 2011

(51) Int. Cl.
*H01R 13/46* (2006.01)

(52) U.S. Cl.
USPC ..... 174/520; 340/854.9

(58) Field of Classification Search
USPC ..... 174/520, 522; 285/115; 166/379, 242.1; 340/854.9, 855.1, 854.3, 854.5, 854.1
See application file for complete search history.

(56) References Cited

U.S. PATENT DOCUMENTS

| | | | | |
|---|---|---|---|---|
| 5,895,992 | A * | 4/1999 | Dreher | 310/80 |
| 6,494,496 | B1 * | 12/2002 | Sweeney | 285/115 |
| 6,670,880 | B1 | 12/2003 | Hall et al. | |
| 6,717,501 | B2 | 4/2004 | Hall et al. | |
| 6,913,093 | B2 | 7/2005 | Hall et al. | |
| 6,929,493 | B2 | 8/2005 | Hall et al. | |
| 6,992,554 | B2 | 1/2006 | Hall et al. | |
| 7,091,810 | B2 * | 8/2006 | Hall et al. | 336/132 |
| 7,298,287 | B2 * | 11/2007 | Hall et al. | 340/854.4 |
| 2004/0113808 | A1 * | 6/2004 | Hall et al. | 340/854.3 |
| 2004/0164833 | A1 * | 8/2004 | Hall et al. | 336/132 |
| 2004/0164838 | A1 * | 8/2004 | Hall et al. | 336/234 |
| 2005/0001738 | A1 * | 1/2005 | Hall et al. | 340/854.8 |
| 2007/0105065 | A1 * | 5/2007 | Snyder et al. | 433/89 |
| 2007/0173105 | A1 * | 7/2007 | Morello | 439/449 |

* cited by examiner

*Primary Examiner* — Angel R Estrada
*Assistant Examiner* — Dimary Lopez Cruz
(74) *Attorney, Agent, or Firm* — Conley Rose, P.C.

(57) ABSTRACT

A transducer device includes an annular housing having a base wall adjoining a pair of annular side walls. The base and side walls define an annular groove. An access port and at least one strain relief opening are formed in the base wall. The at least one strain relief opening is spaced apart from the access port. A conductor is disposed in the annular groove.

16 Claims, 4 Drawing Sheets

TRANSDUCER DEVICE HAVING STRAIN RELIEF COIL HOUSING

TECHNICAL FIELD

The invention relates generally to borehole telemetry systems. More specifically, the invention relates to transducer devices for transmitting signals along a drill string.

BACKGROUND

In downhole drilling operations, downhole measuring tools are used to gather information about geological formations, status of downhole tools, and other downhole conditions. Such data is useful to drilling operators, geologists, engineers, and other personnel located at the surface. This data may be used to adjust drilling parameters, such as drilling direction, penetration speed, and the like, to effectively tap into an oil or gas bearing reservoir. Data may be gathered at various points along the drill string, such as from a bottom-hole assembly or from sensors distributed along the drill string. Once gathered, apparatus and methods are needed to rapidly and reliably transmit the data to the surface. Traditionally, mud pulse telemetry has been used to transmit data to the surface. However, mud pulse telemetry is characterized by a very slow data transmission rate (typically in a range of 1-6 bits/second) and is therefore inadequate for transmitting large quantities of data in real time. Other telemetry systems, such as wired pipe telemetry system and wireless telemetry system, have been or are being developed to achieve a much higher transmission rate than possible with the mud pulse telemetry system.

Wired pipe telemetry systems using a combination of electrical and magnetic principles to transmit data between a downhole location and the surface are described in, for example, U.S. Pat. Nos. 6,670,880, 6,992,554, and 6929493. U.S. Pat. No. 6,670,880, for example, discloses that such a system will transmit data at a rate of least 100 bits/second and conceivably at a rate as high as 1,000,000 bits/second. In these systems, inductive transducers are provided at the ends of wired pipes. The inductive transducers at the opposing ends of each wired pipe are electrical connected by an electrical conductor running along the length of the wired pipe. Data transmission involves transmitting an electrical signal through an electrical conductor in a first wired pipe, converting the electrical signal to a magnetic field upon leaving the first wired pipe using an inductive transducer at an end of the first wired pipe, and converting the magnetic field back into an electrical signal using an inductive transducer at an end of the second wired pipe. Several wired pipes are typically needed for data transmission between the downhole location and the surface.

For uninterrupted data transmission from the downhole location to the surface, the transducer devices used in the wired pipe telemetry system must be electrically and structurally reliable. Several measures have been taken to ensure electrical reliability of inductive transducers. U.S. Pat. No. 6,992,554, for example, describes a robust data transmission element (i.e., inductive transducer) for transmitting information between downhole components. In this patent, the data transmission element includes a U-shaped annular housing. A U-shaped magnetically conducting, electrically insulating (MCEI) element is arranged in the U-shaped annular housing. An insulated conductor is located within the U-shaped MCEI element. As current flows through the insulated conductor, a magnetic flux or field is created around the insulated conductor. The MCEI element contains the magnetic flux created by the insulated conductor and prevents energy leakage into surrounding materials. The annular housing is made of a hard material that is electrically conductive, typically a metal. Although not specifically discussed in this patent, there is a through-hole in the annular housing as well as the MCEI element to allow for insertion of an input lead to the insulated conductor. Thus, a weak spot is inherently designed into the annular housing.

U.S. Pat. No. 6,992,554 discloses that the annular housing stretches as it is forced into the recess within the mating surface of a downhole component. This stretching action provides a rebound force to return the annular housing to its original position when the force is removed. When the annular housing stretches, the area surrounding the through-hole created in the annular housing for the input lead would absorb more of the stretch than the rest of the annular housing. As a result, strain induced in the annular housing as a result of the stretching would concentrate around the through-hole for the input lead. The material in this highly strained region may exceed its elastic limit sooner than the material in the remainder of the annular housing, causing the annular housing and inductive transducer to fail structurally prematurely. This disclosure discloses how to prevent or curb this premature structural failure.

SUMMARY

In a first aspect, the present invention relates to a transducer device comprising: an annular housing having a base wall adjoining a pair of annular side walls, the base and side walls defining an annular groove, the base wall having an access port and at least one strain relief opening formed therein, the at least one strain relief opening being spaced apart from the access port; and a conductor disposed in the annular groove.

In certain embodiments of the first aspect of the present invention, the at least one strain relief opening is a through-hole extending from the exterior surface of the base wall to the annular groove.

In certain embodiments of the first aspect of the present invention, the at least one strain relief opening is a blind hole extending from the exterior surface of the base wall partially into the base wall.

In certain embodiments of the first aspect of the present invention, the at least one strain relief opening is a slot formed in the exterior surface of the base wall.

In certain embodiments of the first aspect of the present invention, the slot is a half-slot having a radial width less than a radial width of the base wall.

In certain embodiments of the first aspect of the present invention, the slot is a full-slot having a radial width equal to a radial width of the base wall.

In certain embodiments of the first aspect of the present invention, a plurality of strain relief openings are formed in the base wall.

In certain embodiments of the first aspect of the present invention, the strain relief openings and access port are uniformly spaced-apart along the base wall.

In certain embodiments of the first aspect of the present invention, the access port extends from the annular groove to an exterior surface of the base wall.

In certain embodiments of the first aspect of the present invention, the conductor extends through the access port to an exterior of the annular housing.

In certain embodiments of the first aspect of the present invention, the annular housing is adapted for mounting on a tubular.

In a second aspect, the present invention relates to a downhole tool comprising: a tubular having a receptacle and a transducer device according to the first aspect of the present invention disposed in the receptacle.

BRIEF DESCRIPTION OF DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
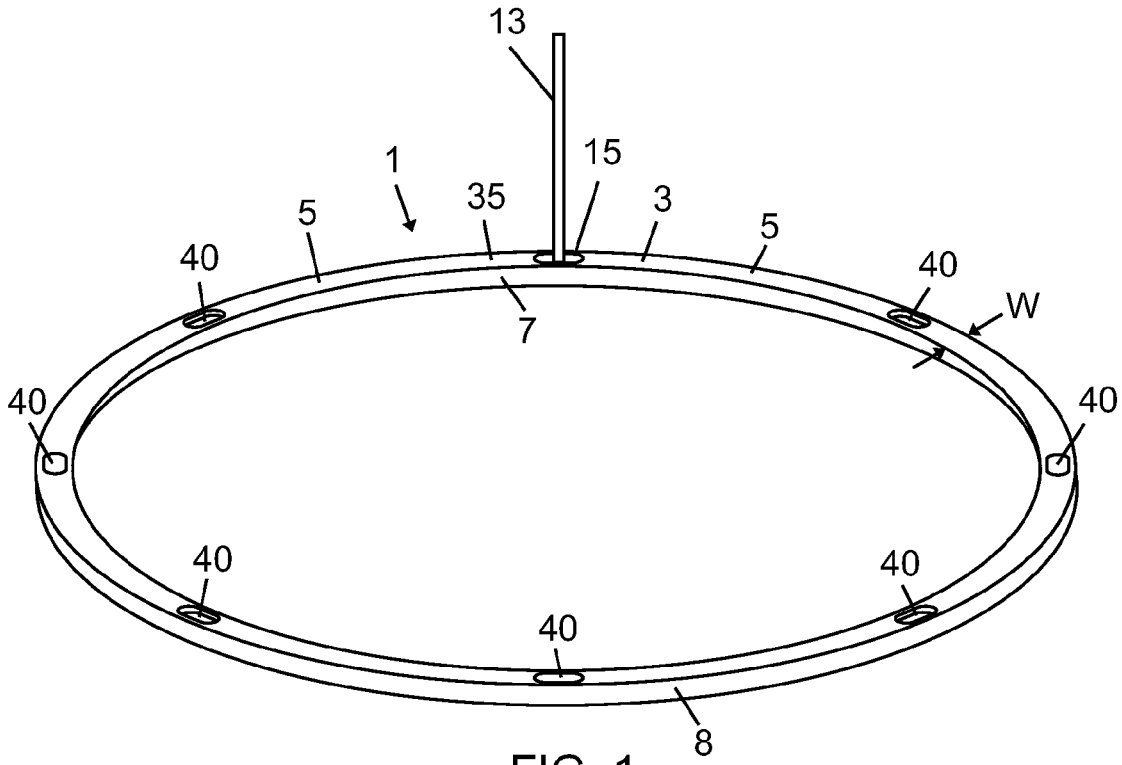
FIG. 1 is a perspective view of a transducer device.

The present invention will now be described in detail, with reference to the accompanying drawings. In this detailed description, numerous specific details may be set forth in order to provide a thorough understanding of the invention. However, it will be apparent to one skilled in the art when the invention may be practiced without some or all of these specific details. In other instances, well-known features and/or process steps may not be described in detail so as not to unnecessarily obscure the invention. In addition, like or identical reference numerals may be used to identify common or similar elements.

Figure 2:
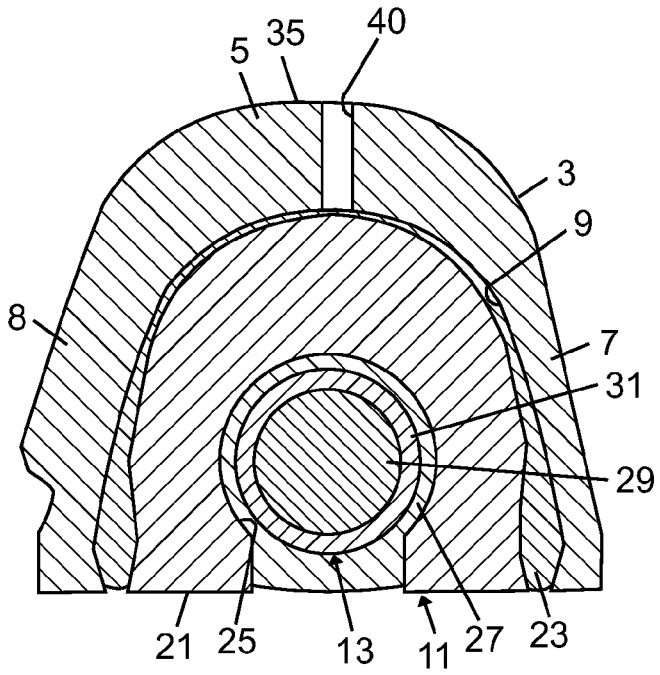
FIG. 2 is a radial cross-section of the transducer device including strain relief through-holes.
Figure 3:
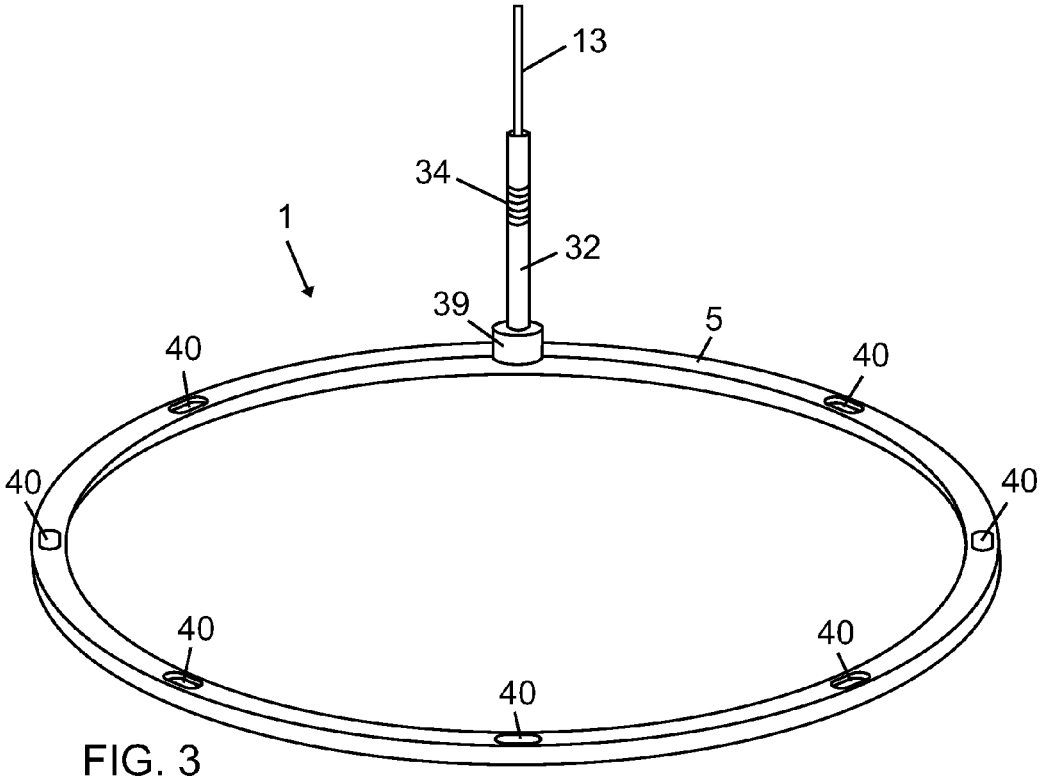
FIG. 3 is a perspective view of a transducer device.

FIG. 1 shows a transducer device 1 according to certain aspects of the present invention. The transducer device 1 has an annular housing 3 made of an inner annular side wall 7, an outer annular side wall 8, and a base wall 5 adjoining the side walls 7, 8. The annular housing 3 is made of a hard electrically conductive material, typically a metal such as steel, titanium, chrome, nickel, aluminum, iron, copper, tin, and lead. FIG. 2 shows that the walls 5, 7, 8 define an annular groove 9. A coil assembly 11 is disposed in the annular groove 9. The coil assembly 11 includes a conductor 13 disposed and retained in an insert 21, where the insert 21 is disposed and retained in the annular groove 9 of the annular housing 3. The conductor 13 is an insulated conductor including a conductor 29 surrounded by an electrically insulating material 31. The conductor 13 may be, for example, a nickel- or silver-plated, copper-clad, stainless-steel wire. Other types of conductors are known in the art. The conductor 13 may have a cross-section that is circular or has other shape, e.g., rectangular. In the coil assembly 11, as current flows through the conductor 13, a magnetic flux or field is created around the conductor 13. In FIG. 1, the conductor 13 extends through an access port 15 formed in the base wall 5. The access port 15 is a through-hole in that it extends through the thickness of the base wall 5 in order to provide a path between the annular groove (9 in FIG. 2) and the exterior surface 35 of the base wall 5. In FIG. 3, an anti-rotation sleeve 39 is installed at the access port (15 in FIG. 1). An insulating coating 32 may be applied on a portion of the conductor 13. A seal stack 34 may be provided on a portion of or above the insulating coating 32 to provide a seal between the conductor 13 and a tool body (i.e., when the transducer device 1 is mounted in a tool body).

In general, the coil assembly 11 may have any configuration suitable for converting a magnetic field to an electrical field or an electrical field to a magnetic field. Examples of suitable coil assemblies are disclosed in, for example, U.S. Pat. Nos. 6,670,880, 6,992,554, and 6,929,493. The insert 21 may be configured to perform functions such as containing magnetic flux created by the conductor 13 within the annular housing 3 and transferring magnetic current to another insert of another transducer device during a data transmission operation using two oppositely-arranged transducer devices. If the coil assembly 11 is similar to the ones disclosed in U.S. Pat. No. 6,992,554, then the insert 21 would be a U-shaped magnetically conducting electrically insulating (MCEI) element as described in U.S. Pat. No. 6,992,554. In this case, the insert 21 may be retained in the annular groove 3 via a polymer layer 23 disposed between the walls 5, 7, 8 of the annular housing 3 and the insert 21. The conductor 13 may be retained in a pocket 25 provided by the insert 21 via a polymer layer 27 disposed in the pocket 25 between the insert 21 and the conductor 13. In an alternative example, the coil assembly 11 may have a structure similar to the one disclosed in U.S. Pat. No. 6,929,493, where the insert 21 would be made of a resilient material and fit snugly in the annular groove 9, and the conductor 13 would fit snugly in a pocket provided by the insert 21. In general, the annular housing 3 and the insert 21 may be provided with snap features such as undercuts and recesses to assist in retaining the insert 21 in place within the annular groove 9 of the annular housing 3.

Referring to FIG. 1 or 3, a plurality of openings 40 are formed in the base wall 5. The openings 40 are for strain relief. At the location of each of the strain relief openings 40 and the access port 15, the base wall 5 has a reduced cross-sectional area. If the strain relief openings 40 had not been formed in the base wall 5 as illustrated in FIG. 1 or 3, strain induced in the annular housing 3 will concentrate mostly at the reduced cross-sectional area at the location of the access port 15, possibly resulting in premature failure of the annular housing 3 as explained in the background. However, with the provision of the strain relief openings 40 in the base wall 5, strain induced in the annular housing 3 (e.g., as a result of the annular housing 3 stretching) will be distributed among the reduced cross-sectional areas at the location of the strain relief openings 40 and the access port 15. By sharing the strain burden, the strain relief openings 40 reduce the amount of strain concentrated at the location of the access port 15. Preliminary tests suggest that providing the strain relief openings 40 in the base wall 5 can potentially increase the life expectancy of the transducer device 1 by a minimum of 2,000% with minimal impact on strength and rebound force of the annular housing 3.

Figure 4:
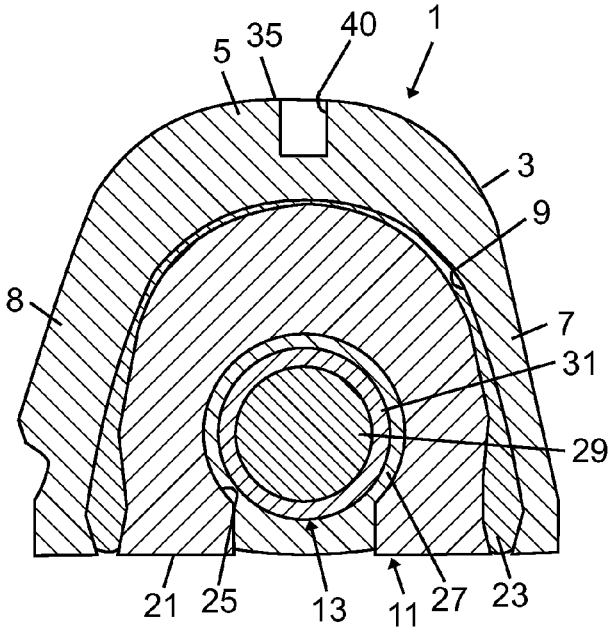
FIG. 4 is a radial cross-section of a transducer device including strain relief blind holes.
Figure 5:
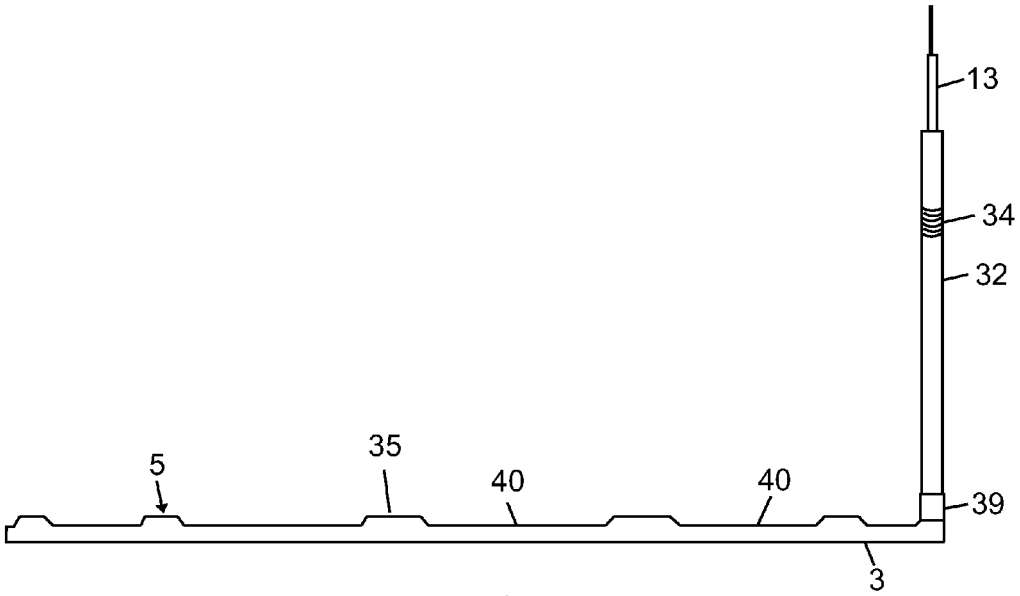
FIG. 5 is a side view of a transducer device including strain relief full-slots.
Figure 6:
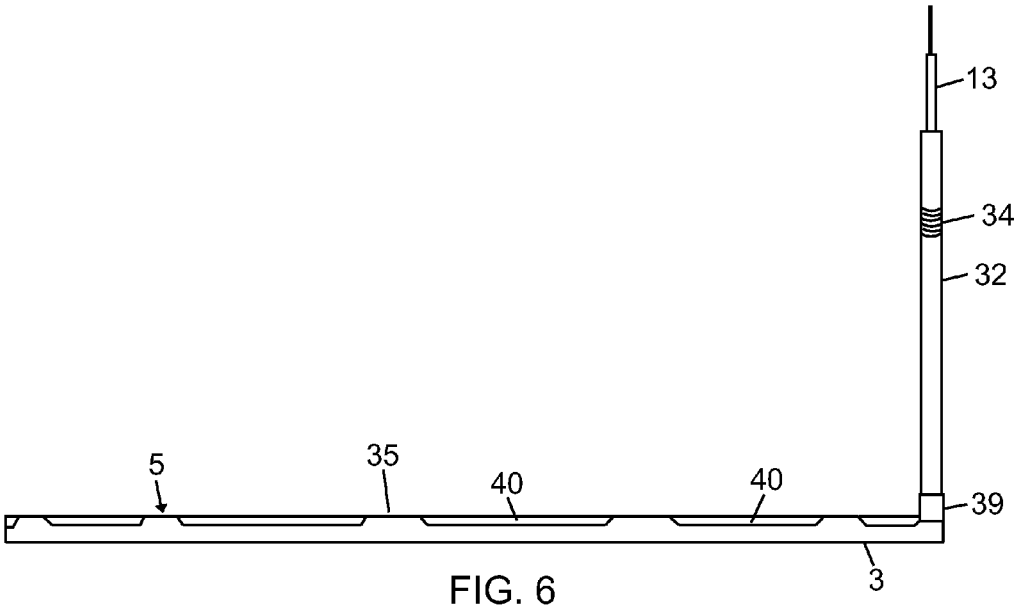
FIG. 6 is a side view of a transducer device including strain relief half-slots.

Preferably, there are at least two strain relief openings 40 formed in the base wall 5 in addition to the access port 15. As shown in FIG. 2, the strain relief openings 40 formed in the base wall 5 may be through-holes, i.e., extending through the base wall 5, from the outer surface 35 of the base wall 5 to the annular groove 9, as shown in FIG. 2. Alternatively, as shown in FIG. 4, the strain relief openings 40 may be blind holes, i.e., extending only partially into the base wall 5 (from the exterior surface 35 of the base wall 5). A mixture of through-hole and blind-hole strain relief openings 40 may be formed in the base wall 5, as shown in FIG. 1 or 3. Alternatively, only through-hole strain relief openings 40 or blind-hole strain relief openings 40 may be formed in the base wall 5. Alternatively, as shown in FIGS. 5 and 6, the strain relief openings 40 may be slots cut in the exterior surface 35 of the base wall 5. In FIG. 5, the slots 40 are full-slots in that they extend fully across the radial width of the base wall 5. The radial width W of the base wall 5 is indicated in FIG. 1. The radial width of a full-slot is equal to the radial width W of the base wall 5. In FIG. 6, the slots 40 are half-slots in that they extend partially across the width of the base wall 5. The radial width of a half-slot is less than the radial width W of the base wall 5. The half-slot may start from the side of the base wall 5 adjacent to the outer annular side wall (8 in FIG. 1) or the side of the base wall 5 adjacent to the inner annular side wall (7 in FIG. 1) to some point along the radial width W of the base wall 5. The wall of each of the strain relief openings 40 may be straight or may be angled or chamfered. In FIGS. 1, 3, 5, and 6 the strain relief openings 40 are spaced apart from the access port 15 and also from each other. Preferably, the strain relief openings 40 and access port 15 are uniformly spaced apart along the base wall 5 so that the strain induced in the annular housing 3 is uniformly distributed along the base wall 5. The strain relief openings 40 may have any desired shape, e.g., circular, square, rectangular, oval, rectangular with rounded corners, and square with rounded corners. Preferably, the strain relief openings 40 do not have sharp corners at the exterior surface 35 of the base wall 5 that can act as stress concentrators.

Figure 7:
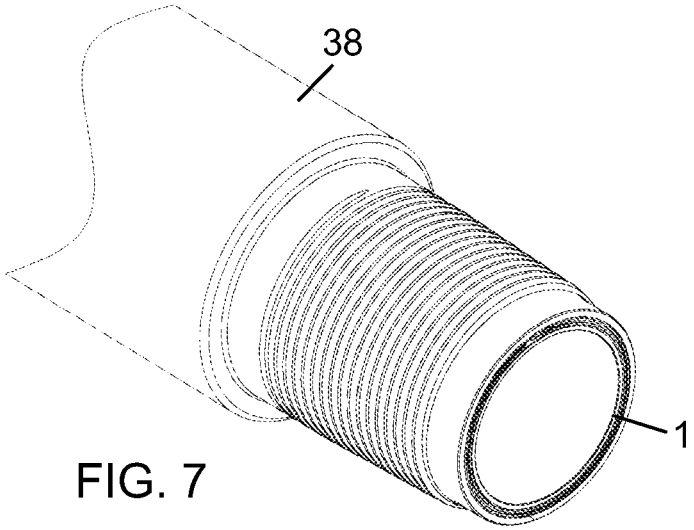
FIG. 7 shows the transducer of FIG. 1 mounted on a downhole tool.
Figure 8:
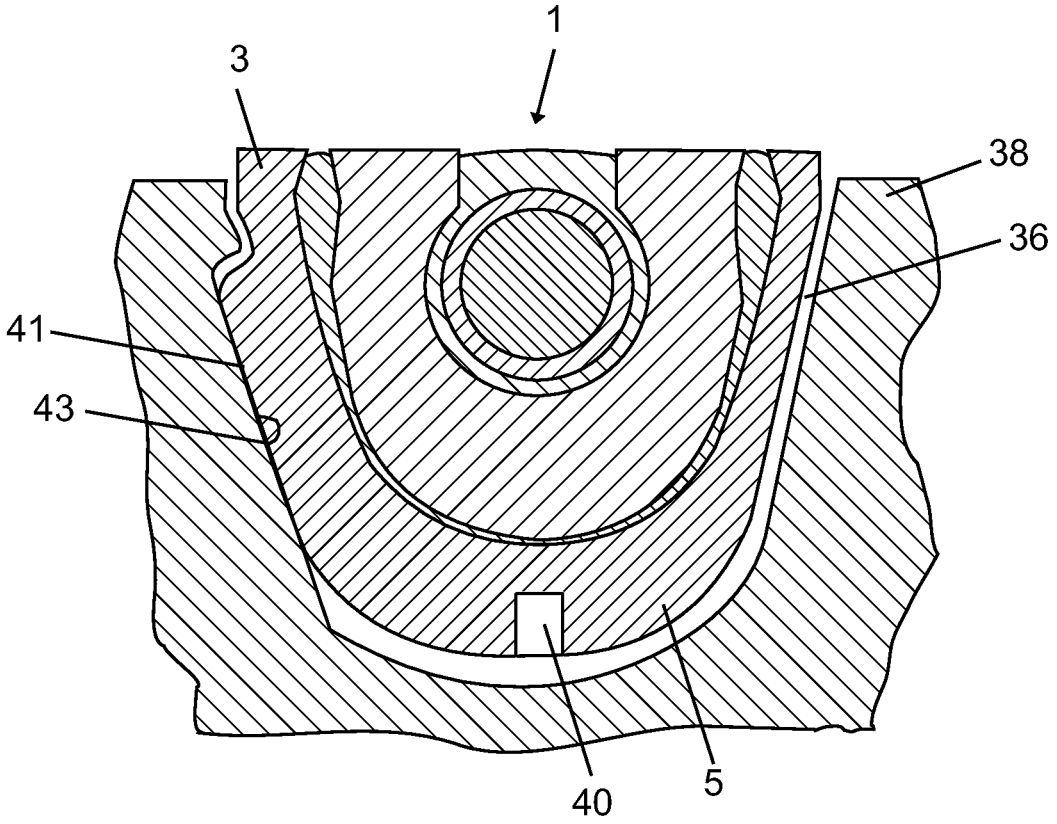
FIG. 8 is a radial cross-section of a transducer device mounted in a recess of a downhole tool.

FIG. 7 shows the transducer device 1 mounted on a downhole tool 38. In FIG. 7, the downhole tool 28 is a tubular. The tubular can be any tubular adapted for use in borehole operations, e.g., drill pipe, casing, metallic pipe, non-metallic pipe, wired pipe, and non-wired pipe. In FIG. 8, the transducer device 1 is disposed in a recess 36 of the downhole tool 38. The downhole tool 38 may be, for example, a wired pipe, and the recess 36 may be formed in a shoulder of the wired pipe. In FIG. 8, the annular housing 3 has an angled surface 41, and the recess 36 has an angled surface 43 in opposing relation to the angled surface 41 of the annular housing 3. The angled surface 41 of the annular housing 3 acts as a spring against the angled surface 43 of the recess 36. As force is applied to the transducer device 1 and the angled surface 41 presses down on the angled surface 43, the annular housing 3 stretches. This stretching action provides a rebound force to return the annular housing 3 to its original position once the force is removed. The stretching of the annular housing 3 will induce strain in the annular housing 3. As explained above, the strain relief openings 40 in the base wall 5 of the annular housing 3 will distribute the induced strain along the base wall 5 so that the annular housing 3 does not fail prematurely due to excess concentration of strain at a single location (i.e., at access port 15 in FIG. 1) in the base wall 5.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A transducer device, comprising:

an annular housing having a base wall adjoining a pair of annular side walls, the base and side walls defining an annular groove, the base wall having an access port and at least one strain relief opening formed therein, the at least one strain relief opening being spaced apart from the access port; and a conductor disposed in the annular groove.

2. The transducer device of claim 1, wherein the at least one strain relief opening is a through-hole extending from an exterior surface of the base wall to the annular groove.

3. The transducer device of claim 1, wherein the at least one strain relief opening is a blind hole extending from an exterior surface of the base wall partially into the base wall.

4. The transducer device of claim 1, wherein the at least one strain relief opening is a slot formed in an exterior surface of the base wall.

5. The transducer device of claim 4, wherein the slot is a half-slot having a radial width less than a radial width of the base wall.

6. The transducer device of claim 4, wherein the slot is a full-slot having a radial width equal to a radial width of the base wall.

7. The transducer device of claim 1, wherein a plurality of strain relief openings are formed in the base wall.

8. The transducer device of claim 7, wherein the strain relief openings and access port are uniformly spaced apart along the base wall.

9. The transducer device of claim 1, wherein the access port extends from the annular groove to an exterior surface of the base wall.

10. The transducer device of claim 1, wherein the conductor extends through the access port to an exterior of the annular housing.

11. The transducer device of claim 1, wherein the annular housing is adapted for mounting on a tubular.

12. A downhole tool, comprising:

a tubular having a receptacle; and a transducer device disposed in the receptacle, the transducer device comprising: (i) an annular housing having a base wall adjoining a pair of annular side walls, the base and side walls defining an annular groove, the base wall having an access port and at least one strain relief opening formed therein, the at least one strain relief opening being spaced apart from the access port; and (ii) a conductor disposed in the annular groove.

13. The transducer device of claim 1, wherein the access port is formed in the base wall.

14. The transducer device of claim 1, wherein the strain relief opening is configured to reduce strain on the access port.

15. The downhole tool of claim 12, wherein the strain relief opening extends only partially into the base wall.

16. The downhole tool of claim 12, wherein the access port is formed in the base wall.

* * * * *